US006350096B1

(12) United States Patent
Helver

(10) Patent No.: US 6,350,096 B1
(45) Date of Patent: Feb. 26, 2002

(54) BINDING ASSEMBLY

(76) Inventor: Oscar Helver, 13340 S.W. 128th Street, Miami, FL (US) 33186

( * ) Notice: Subject to any disclaimer, the term of this patent is extended or adjusted under 35 U.S.C. 154(b) by 0 days.

(21) Appl. No.: 09/431,149

(22) Filed: Nov. 1, 1999

(51) Int. Cl.[7] ..... B42B 5/00

(52) U.S. Cl. ..... 412/33; 270/58.08; 412/9; 412/38

(58) Field of Search ..... 412/9, 33, 38, 412/39, 40, 42, 43; 270/52.08, 58.07, 58.08

(56) References Cited

U.S. PATENT DOCUMENTS 3,756,625 A * 9/1973 Abilgaard et al. ..... 281/25
3,866,254 A * 2/1975 Gronda ..... 11/1 AC
3,967,336 A * 7/1976 Cutter ..... 11/1 AC
4,008,501 A * 2/1977 Cutter ..... 11/1 AC
5,211,522 A * 5/1993 Ho ..... 412/16
5,299,898 A * 4/1994 Kaufmann et al. ..... 412/7
5,553,959 A * 9/1996 Feldman et al. ..... 402/79

* cited by examiner

*Primary Examiner*—A. L. Wellington
*Assistant Examiner*—Monica S. Carter
(74) *Attorney, Agent, or Firm*—Malloy & Malloy, P.A.

(57) ABSTRACT

A binding assembly structured to secure a plurality of material sheets having a series of binding aperture on a corresponding series of binding elements of the type that include a wide perimeter flange. The binding assembly includes an alignment assembly which maintains the binding elements generally vertically oriented, a guide assembly which positions an edge of the material sheet in generally aligned relation with a perpendicular axis region of the binding elements, a displacement assembly which urges the material sheet and the binding elements into coupled engagement with one another at the corresponding binding apertures on the material sheet, and an actuation assembly which initiates operation of the displacement assembly.

46 Claims, 3 Drawing Sheets

BINDING ASSEMBLY

BACKGROUND OF THE INVENTION

1. Field of the Invention

The present invention relates to a binding assembly especially configured to secure a plurality of material sheets, having binding apertures defined therein, on a binding element of the type including a perimeter flange over which the binding aperture is secured. The binding assembly is configured to allow continuous and/or multi-page binding onto a plurality of the binding elements in a manual or automated fashion, but with a substantial degree of ease and consistency, thereby increasing the effective use of the binding system which incorporates the aforementioned binding elements and binding apertures.

2. Description of the Related Art

There are numerous types of binding systems in existence today which are particularly configured for binding a plurality of material sheets, such as sheets of paper, together into a single, well organized unit. Typically, the binding systems secure a large number of the material sheets with one another in such a manner that the user can subsequently flip through the material sheets, reading and/or writing on each individual material sheet as they deem necessary.

Within the field of art relating to binding systems, the style and nature of the systems is often differentiated between a more professional, manufacturer implemented binding system, such as those utilized to bind books and/or notebooks, versus less permanent binding systems which allow the individual users to selectively add and/or remove material sheets, while still effectively binding a volume of material sheets in a customized manner as desired by the user. Of this latter type of binding system, the most common types involve the use of hole punch devices so as to allow the material sheets to be fitted over the individual prongs of a ring binder type system. Additionally, other types of binding systems wherein a more permanent, heat sealed binding is achieved, or a temporary clamped type binding system are employed, are often utilized by consumers.

In addition to the preceding conventional types of binding systems, newly developed binding systems, such as the notebook system recited in U.S. Pat. No. 5,553,959 have been developed so as to provide a greater degree of manageability to the individual material sheets, while still providing a compact and secure binding system. Typically, such a binding system incorporates the utilization of one or more binding elements 20', 20" as in FIGS. 1 through 5, often having a disk-type shape, and including a perimeter flange 24, 24' which sets a wider thickness of the binding element than at a central region 22. The corresponding material sheets 16, 16' which are to be secured to the binding element 20, 20' formed with one or more binding apertures 30 to correspond to the number of binding elements which will be used for binding purposes. For example, a typical binding configuration provides for the spacing of binding elements every inch along the edge of a material sheet, thereby resulting in a position of a binding aperture at correspondingly spaced locations. Moreover, the binding aperture is typically of the type that includes a generally narrow channel at the edge of the material sheet which leads into a wider segment. As a result, as the binding aperture is placed over the binding element, the wider section retains the perimeter flange while the narrower channel encloses the binding aperture about the perimeter flange preventing facilitated removal of the material sheet from the binding element. As can be appreciated, accordingly, in order to secure a material sheet to the individual binding elements, the material sheet must generally be deformed at the binding aperture so as to generally widen the narrower channel, to pass about the perimeter flange and result in the securement of the material sheet to the binding element.

Unfortunately, however, despite the attendant advantages with the use of such new binding systems, the effective securement of the material sheets to the binding elements can often be seen as a difficult and time consuming task, as each material sheet must be secured to each binding element in a manual fashion. As a result, there is a substantial need in the art for a binding assembly which is specifically configured and suited to enable the uniform and effective securing of the material sheets having the binding apertures formed therein on the corresponding number of binding elements, preferably in a simultaneous and a multiple sheet manner which achieves uniform and rapid binding of a large number of the material sheets. Furthermore, such an improved binding assembly should be configured to facilitate the securement of the large plurality of material sheets in a sequential and convenient manner, thereby facilitating the utilization of a binding system including the plurality of binding elements.

SUMMARY OF THE INVENTION

The present invention is directed towards a binding assembly particularly configured for securing a plurality of material sheets including a plurality of binding apertures defined thereon to a corresponding plurality of binding elements. The binding elements are typically of the type which include an increased width perimeter flange which is retained within the binding aperture of the material sheets, thereby providing for secure, yet movable interconnection between the material sheets and the binding element.

The binding assembly of the present invention includes an alignment assembly. The alignment assembly is structured to at least temporarily maintain a plurality of the binding elements generally perpendicular to a plane of the material sheets, at least upon introduction of the material sheets into the binding assembly. Moreover, a guide assembly is also preferably provided in the structure so as to position an edge of at least one of the material sheets in generally aligned relation with a perpendicular axis region of each of the plurality of binding elements. Typically, a substantially straight line positioning of the binding elements relative to one another, and accordingly, a conforming straight line positioning of the edge of the material sheet is preferred.

The binding assembly further includes a displacement assembly. In particular, the displacement assembly is structured to urge the material sheet into engaging relation with the plurality of binding elements in such a manner that the binding apertures of the material sheets are effectively deformed and pass over the perimeter flange of the binding element, thereby providing secure coupled engagement between the material sheet and the binding element. Based upon the aligned positioning of the edge of the material sheet which contains the binding apertures with the perpendicular axis region of the binding elements, the displacement assembly generally urges the material sheet into co-planer engagement with the confronting surface of the binding element at that perpendicular axis region. As a result, effective deformation of the binding aperture occurs and facilitated passage of the binding element into the binding aperture results.

The binding assembly of the present invention further includes an actuation assembly. The actuation assembly is structured to at least initiate operation of the displacement assembly, thereby resulting in the urging of the material sheet, by the displacement assembly, into effective binding engagement with each of the plurality of binding elements.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 4:
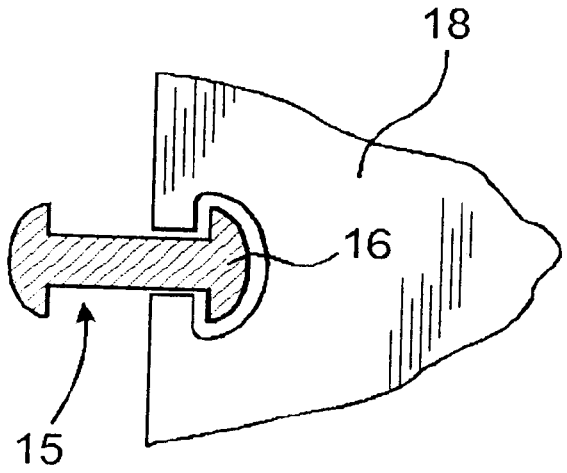
FIG. 4 is a partial, cross-sectional illustration illustrating the binding element secured to a material sheet after binding utilizing the binding assembly of the present invention.

Shown throughout the Figures, the present invention is directed towards a binding assembly, generally indicated as 10. In particular, the binding assembly 10 is preferably structured to bind one or more material sheets, such as paper, each of those material sheets preferably having at least one binding aperture 19 defined therein which is structured to receive a binding element 15. Preferably, the material sheet 18 includes the plurality of the binding apertures 19 disposed a spaced apart distance from one another along an edge thereof, each binding aperture 19 structured to be correspondingly fitted onto one of a plurality of the binding elements 15. Moreover, the individual binding elements 15 are preferably, but not necessarily of the type which include a perimeter flange 16 which preferably surrounds a reduced thickness central portion 17. The perimeter flange 16, as best seen in FIG. 4, is structured to be introduced into the binding aperture 19 such that removal of the material sheet 18 is generally restricted. As to the individual binding apertures, they may be formed by a hole punching device which may or may not be integrated as part of the binding assembly 10 of the present invention.

Looking particularly to the illustrated embodiment of the binding assembly 10, it includes an alignment assembly, generally indicated as 30. The alignment assembly 30 is structured to at least temporarily maintain at least one of the binding elements 15 in an orientation that is generally perpendicular to a plane of the material sheet 18 as it is introduced into the binding assembly 10. Along these lines, in the preferred, illustrated embodiment, the binding element 15 is maintained in a generally vertical orientation by the alignment assembly 30, thereby facilitating generally flat introduction of the material sheet 18 into the binding assembly 10.

Figure 1:
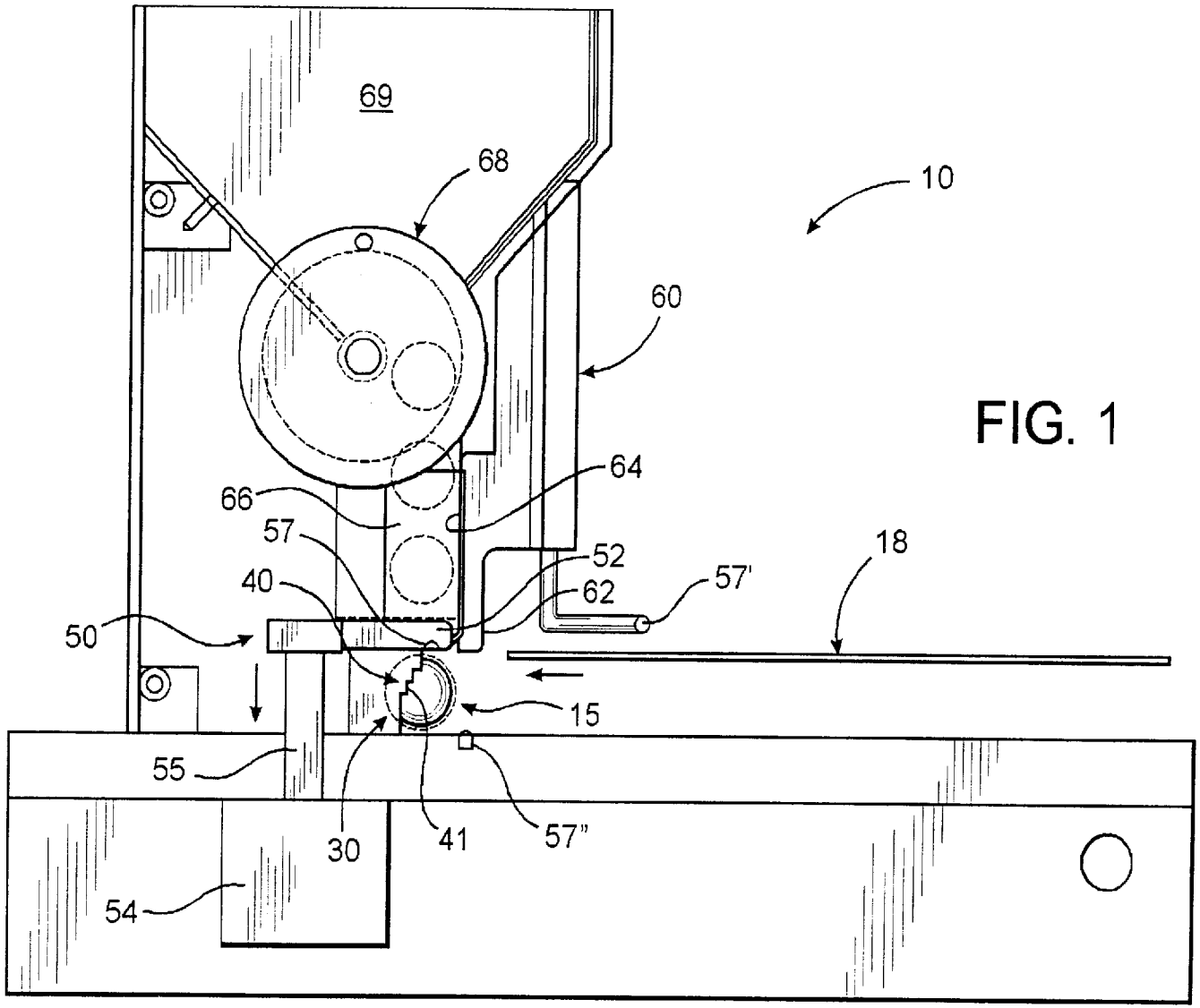
FIG. 1 is a side cross section view of an embodiment of the binding assembly of the present invention.
Figure 2:
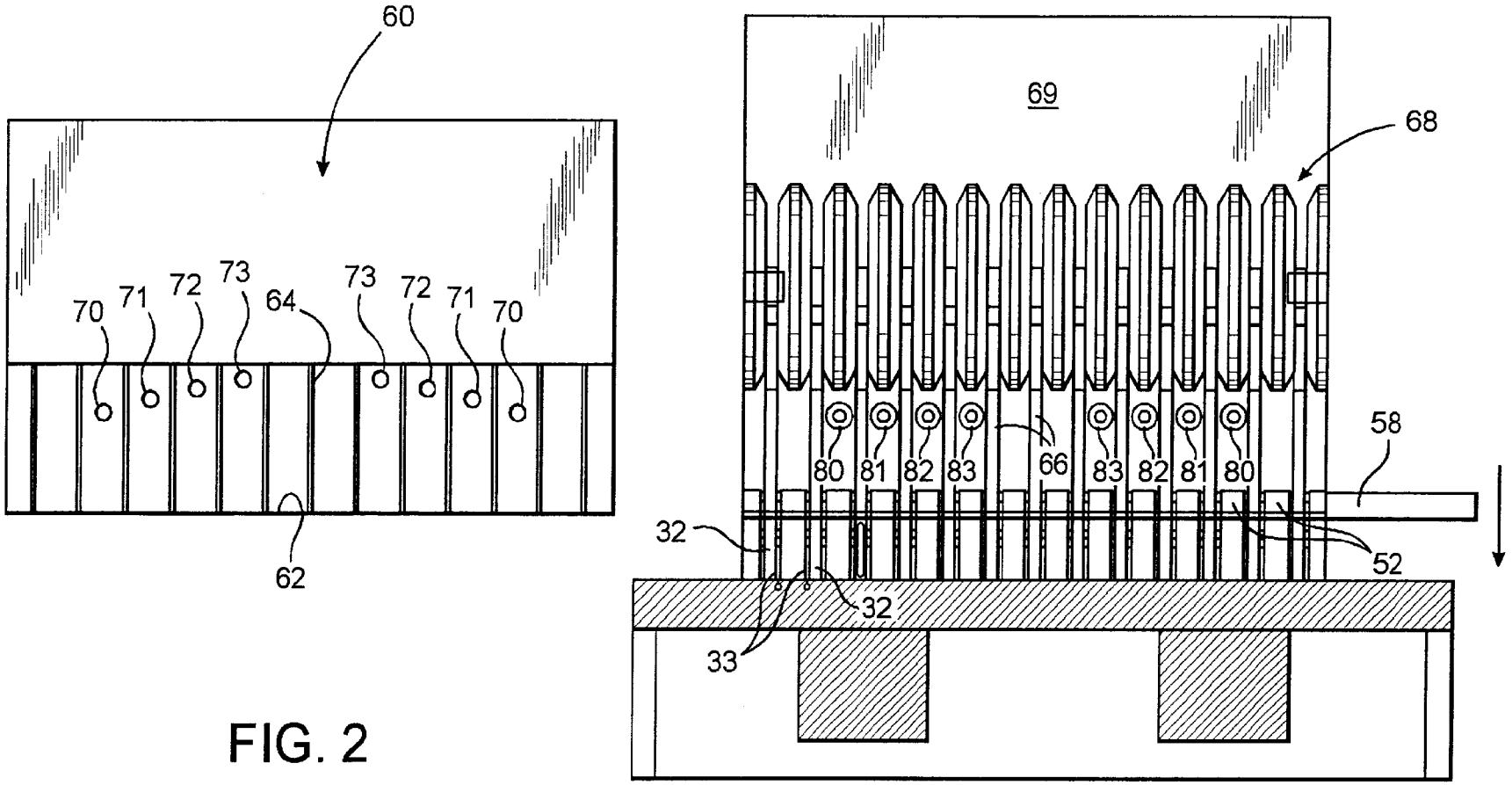
FIG. 2 is a front, exploded view of an embodiment of the binding assembly of the present invention.
Figure 3:
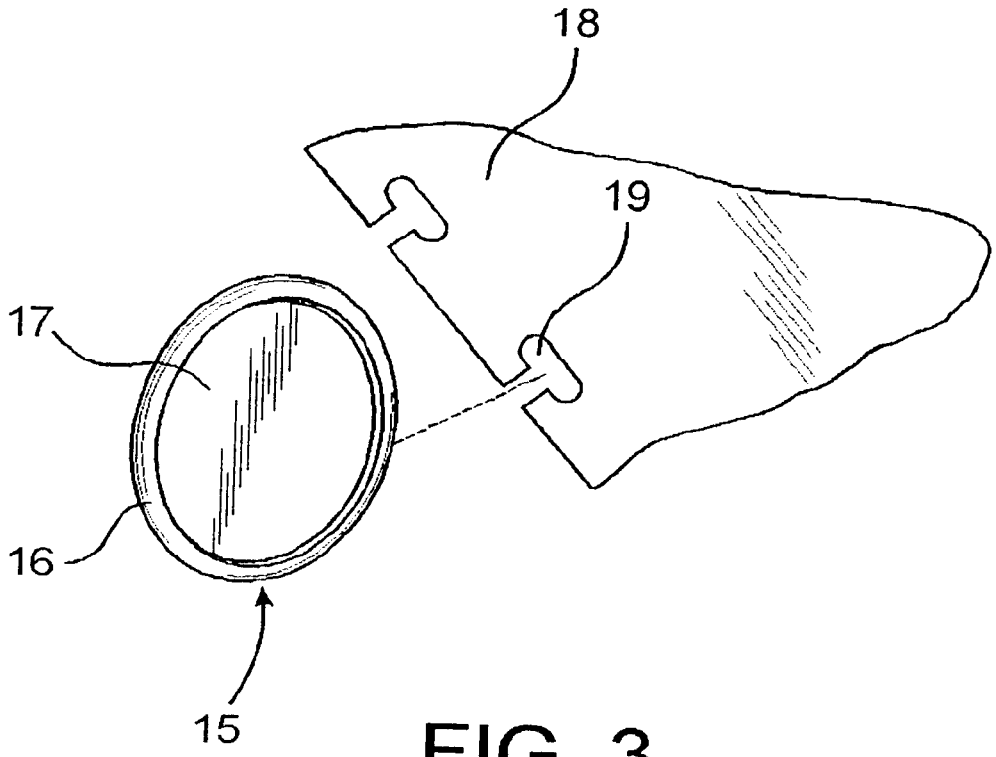
FIG. 3 is a perspective partial illustration of the binding element preferably utilized in the illustrated embodiment of the binding assembly of the present invention.

In the illustrated embodiment, the alignment assembly 30 maintains a plurality of the binding elements 15 in the generally perpendicular, vertical orientation such that all the binding elements 15 may be generally simultaneously coupled with the material sheet 18, as will be described. Along these lines, the alignment assembly 30 includes a generally elongate housing that includes at least one, but preferably a plurality of individual retention troughs 32 defined therein. Each of the retention troughs 32 are preferably generally narrow, so as to correspond to a vertical dimension of the individual binding elements 15, and are spaced apart from one another so as to define a desired spacing between the binding elements 15. Moreover, as best seen in FIGS. 1 and 2, the alignment assembly 30, and in particular the wall elements 33 which border and define the retention troughs 32 are configured such that a portion of the binding element 15, and preferably at least the perpendicular axis region of the binding element 15 is generally exposed to vertical engagement by the material sheet 18, as will be described.

In order to effectively position the individual binding elements 15 within the corresponding retention troughs 32, a guide channel 66 is generally provided. The guide channel 66 is preferably structured to be variably sized, as will be discussed subsequently, so as to appropriately accommodate a particular size binding element 15. As a result, variation of the size of the guide channel 66 allows for the effective regulation of the size of the binding elements 15 to a desired dimension corresponding the binding job to be performed.

The guide channel 66 is preferably disposed in operative communication with a retention area 69 wherein a plurality of the binding elements 15 may be disposed. The retention area 69 is preferably a generally open area that is operatively interconnected with the guide channel 66. In the illustrated embodiment a plurality of guide wheels 68 are disposed in the retention area 69 to direct access into the guide channel 66. In particular, the guide wheels 68 are preferably structured to rotate so as to generally direct the binding elements 15 into the guide channels 66 in an aligned, vertical fashion, even though the binding elements 15 may be collected in a random manner within the retention area 69.

Looking further to the guide channel 66, the present invention may be configured such that a plurality of the binding elements 15 are disposed in a generally stacked orientation within each of the guide channels 66. As a result, upon removal of all of the binding elements currently operatively disposed within the retention troughs 32, the next series of binding elements contained within the guide channels 66 would appropriately drop into place within the retention troughs 32. Of course, the present invention may also provide a configuration wherein only a single binding element may drop into the guide channel, and/or wherein some type of restrictor system that allows only one of the stacked binding elements 15 to drop into the retention troughs 32 at a time, such as when affirmatively dictated by a user and/or when the binding elements currently within the retention troughs 32 are actually removed, may also be included.

The binding assembly 10 of the present invention further includes a guide assembly, generally 50. The guide assembly 50 is structured to position an edge of the material sheet 18 in generally aligned relation with the perpendicular axis region of the preferably vertically oriented binding elements 15. In this regard, it is noted that one or more material sheets 18 may be coupled to the binding elements 15 at one time, although single sheet feeding is generally preferred. Moreover, the present invention recognizes that it is generally preferable to maintain the edge of the material sheet 18 in generally aligned relation with the perpendicular axis region of the binding element 15 so as to facilitate effective coupling therebetween. Specifically, when the material sheet is urged onto the binding element in generally co-planar engagement with a confronting surface, such as at the upper, preferably perpendicular axis region of the vertically aligned binding elements 15, the most facilitated introduction of the binding aperture 19 over the perimeter flange 16 of the binding elements 15 is achieved. As a result, achieving proper aligned positioning by the guide element facilitates more effective and facilitated coupled engagement.

In the illustrated embodiment, the guide assembly 40 may be integrally formed with the wall element 33 which define the retention troughs 32. Additionally, the guide assembly 40 preferably includes at least one stopper element 41 structured to be affirmatively engaged by the edge of the material sheet 18 so as to resist movement of the material sheet 18 beyond the perpendicular axis region of the binding element 15. Preferably, the stopper elements 41 are disposed on opposite sides of each of the retention troughs 32, and as a result, effectively align the entire edge of the material sheet 18 uniformly over the plurality of uniformly positioned binding elements 15 that have been retained within the spaced and aligned retention troughs 32. Because, however, in some instances binding elements of different sizes may be utilized for different jobs with the same binding assembly 10, the stopper elements 41 also preferably include a series of steps defined thereon. Each of the steps is specifically configured and disposed to correspond an appropriate size binding element 15, which may be utilized within the present invention. As a result, depending upon the size of the binding element 15 which is permitted to pass through the guide channel 66, a corresponding step of the stopper element 41 will be effectively exposed for engagement by the material sheet 18 at a corresponding depth and height to match the binding elements 15 used.

Along these lines, the present invention also includes a channel restrictor, generally 60. The channel restrictor 60 is preferably configured not only to vary a size of the guide channel 66, but also to selectively expose a corresponding step of the stopper element 41 in accordance with a size of the binding element 15 that is being used. In particular, the channel restrictor 60 preferably includes a flange element 62 which extends downwardly and generally covers and/or conceals a portion of the stopper element 41. As a result, the lower the flange element 62 is positioned, the lower the engagement point or step on the stopper element 41 that is revealed for engagement by the material sheet 18. Indeed, the material sheet 18 is preferably introduced as high up as is possible, the flange element 62 providing a general guide as to an uppermost point of introduction towards the binding elements 15 wherein the material sheet 18 should be introduced so as to engage the appropriate step of the stopper element 41, and to only be introduced at the appropriate depth.

In addition to the flange element 62, the channel restrictor 60 also preferably includes one or more interior spacers 64 that variably extend into the guide channels 66 so as to restrict and/or vary a size thereof. The spacers 64 may be segmented and or continuous, extend only into a portion of the guide channel 66 and/or completely up through the guide wheels 68 as to provide affirmative sizing of the guide channel 66 throughout. Furthermore, because the spacers 64 and the flange element 62 are preferably both formed as part of the channel restrictor 60, adjustment of the channel restrictor 60 so as to vary a size of the guide channel 66 will also reposition the flange element 62 so as to expose an appropriate engagement point on the stopper element 41.

Turning to FIG. 2, the channel restrictor 60 is preferably structured to be operatively and variably coupled with the housing of the binding assembly 10 at one of a plurality of variable positions. In particular, in the illustrated embodiment, a series of stud type elements 80, 81, 82 and 83 are preferably disposed to extend outwardly from the housing. The channel restrictor 60 includes a corresponding number of apertures 70, 71, 72 and 73 structured to receive corresponding ones of the studs 80, 81, 82 and 83. In particular, the apertures 70, 71, 72 and 73 are preferably disposed in a generally stepped orientation. Moreover, the apertures 70, 71, 72 and 73 are also preferably sized to correspond a particular one or pair of the studs 80, 81, 82 and 83. For example, apertures 73 are preferably structured to receive studs 83, with apertures 72 receiving studs 82, apertures 71 receiving studs 81, and apertures 70 receiving studs 80. Because of the stepped orientation of the apertures 70, 71, 72 and 73, only two of the apertures and two of the studs will be in operative engagement with one another at a particular time. When, however, a different ones of the apertures are engaged, a height of the flange element 62 is effectively varied so as to appropriately expose the desired engagement point of the stopper element 41. Moreover, the studs 80, 81, 82 and 83, based preferably in part on the sizing thereof or of the apertures, are preferably configured so as to extend through the apertures 70, 71, 72 and 73 only a limited or predefined amount which varies depending upon the stud/aperture pairing used. As a result, in the illustrated embodiment, the studs 83 extend only a maximum amount through the apertures 73 so as to minimize a size of the guide channel 66, while studs 80 extend a minimum amount through the apertures 70 so as to maximize a size of the guide channel 66 to correspond a larger binding element. This variable extension through the apertures can be achieved by a stepped and/or tapered configuration of the studs or apertures. As a result, when the apertures 73 engage the studs 83, a maximum introduction of the spacers 64 is achieved so as to minimize the size of the guide channel 66 and lower the flange element 62 a maximum amount. When, however, apertures 70 are passed over studs 80, a maximum size of the guide channel 66 is achieved and the flange element 62 is elevated to its maximum point allowing for the highest engagement point of the stopper element 41 to be exposed.

In order to effectively urge the material sheets 18 and the binding elements 15 into coupled engagement with one another, the binding assembly 10 of the present invention also includes a displacement assembly, generally 50. In particular, the displacement assembly 50 is structured to at least partially engage the material sheet 18 so as to urge the material sheet 18 into the generally co-planer engagement with the confronting surface of the binding element 15, at generally the perpendicular axis region of the binding element 15. As a result of this generally co-planar engagement by the edge of the material sheet 18, preferably with each binding aperture 19 properly positioned over a confronting upper surface of the vertically disposed binding element 15, the binding aperture 19 will be at least temporarily deformed and will pass more easily over the perimeter flange 16 of the binding element 15. In the illustrated embodiment, the displacement assembly 50 preferably simultaneously urges one or a plurality of the material sheets downwardly into coupled engagement with all of the binding elements 15, the co-planar positioning allowing the more facilitated deformation and facilitated coupled engagement. Of course, it is noted, that although in the illustrated embodiment the material sheet 18 is essentially pushed onto the binding elements 15, urging of both the binding element 15 and material sheet 18 towards one another and/or urging of the binding elements 15 into the material sheet 18 are equivalently acceptable. Also, although a plurality of the material sheet 18 can be urged into couple engagement with the binding elements 15 at the same time, it may be preferred that only a small number of material sheets be placed on the binding elements 15 at once, a generally sequential urging of the material sheets into coupled engagement with the binding elements being achieved.

The displacement assembly 50 of the present invention includes at least one but preferably a plurality of displacement elements 52. In particular, the displacement elements 52 are preferably structure to straddle each of the alignment troughs 32 and extend sufficiently outward so as to be able to engage an upper surface of the material sheet 18 once it has engaged the stopper element 41. Although a pivotal displacement element 52 may be utilized, in the illustrated embodiment, the displacement element 52 preferably includes a generally rigid segment structured to vertically move between a pre-displacement orientation above the binding element 15, and a post displacement orientation which has passed downwardly beyond an edge of the binding element 15 so as to effectively pass the material sheet 18 onto the binding element 18. In this regard, a piston type assembly 55 may be provided with a biasing element structured to automatically return the displacement element 52 to its pre-displacement orientation after each time it has urged one or more of the material sheets onto the binding elements 15.

In order to initiate operation of the displacement assembly 50, the present invention also includes an actuation assembly. In the embodiment of FIG. 1, the actuation assembly includes an automated actuation device 54 such as including a motor which will generally automatically initiate movement of the displacement element 52, and accordingly operation of the displacement assembly 50. In this embodiment of the actuation assembly a micro switch and/or sensor as at 57 may be provided so as to trigger the automatic actuation device 54 and appropriately provide for movement of the displacement element 52 so as to urge the material sheet 18 onto the binding element 15. Preferably, this micro switch and/or sensor 57 is structured to initiate operation of the displacement 50 when the material sheet 18 has been effectively positioned in a appropriate aligned orientation, such as after it has engaged the stopper element 41. Moreover, it may be desirable that either the sensor 57 or another sensor 57' be provided to ensure that a user's finger or another article does not accidentally become introduced into the assembly during its operation.

It is also noted that the micro switch may be disposed in and/or associated with the stopper element 41, if desired. Also, however, the automated actuation device 54 may be configured so as to sequentially move the displacement assembly into displacing engagement with the material sheet 18 at a predefined rate. For example, a control knob 56 or other like device can be effectively configured so as to define a sequential rate at which the displacement assembly 50 moves the displacement element 52. Naturally, a faster or slower rate can be provided depending upon the speed and/or skill of the particular operator that will be feeding the material sheets 18 into the binding assembly 10 of the present invention. Likewise, some automated feeding configuration can be provided so as to feed the material sheets 18 into the binding assembly 10 at a predefined rate which can be corresponded to the rate of the automated actuation device 54. In this and/or another embodiment, a counter assembly 57" may be provided so as to keep track of the number of pages bound.

Conversely, the actuation assembly can include also a lever arm 58 which is exteriorly actuatable by the user. In this embodiment, a user merely positions the material sheet 18 in an appropriately aligned orientation and displaces the lever arm 58 to result in appropriate movement and/or actuation of the displacement assembly 50 to urge the material sheet 18 onto the binding elements 15.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. To secure a plurality of material sheets having at least one binding aperture on a binding element of the type including a perimeter flange, a binding assembly comprising:

an alignment assembly structured to at least temporarily maintain the binding element generally perpendicular to a plane of the material sheet;

a guide assembly structured to position an edge of at least one of the plurality of material sheets in generally aligned relation with a perpendicular axis region of the binding element;

a displacement assembly structured to urge the material sheet and the binding element into coupled engagement with one another at the corresponding binding aperture of the material sheet; and said displacement assembly further comprising a pair of displacement elements disposed on opposite sides of a retention trough and structured to engage the material sheet, at least upon the material sheet engaging said guide assembly, on opposite sides of the binding aperture so as to urge the material sheet onto the binding element.

2. A binding assembly as recited in claim 1 wherein said displacement assembly at least partially engages the material sheet and urges the material sheet into generally co-planer engagement with a confronting surface of the binding element at generally said perpendicular axis region, so as to at least temporarily deform said binding aperture and permit passage of the perimeter flange of the binding element therethrough.

3. A binding assembly as recited in claim 1 wherein said displacement assembly is structured to simultaneously urge a plurality of the material sheets and the binding element into coupled engagement with one another.

4. A binding assembly as recited in claim 1 wherein said displacement assembly is structured to sequentially urge a plurality of the material sheets and the binding element into coupled engagement with one another.

5. A binding assembly as recited in claim 1 wherein said alignment assembly is structured to at least temporarily maintain a plurality of the binding elements generally perpendicular to the plane of the material sheet.

6. A binding assembly as recited in claim 5 wherein said displacement assembly is structured to simultaneously urge the material sheet and the plurality of the binding elements into coupled engagement with one another at a corresponding plurality of the binding apertures on the material sheet.

7. A binding assembly as recited in claim 6 wherein said guide assembly is structured to position the edge of the material sheet in generally aligned relation with the perpendicular axis region of each of the plurality of the binding elements.

8. A binding assembly as recited in claim 1 further comprising an actuation assembly structured to at least initiate operation of said displacement assembly.

9. A binding assembly as recited in claim 8 wherein said actuation assembly is operatively associated with said guide assembly such that positioning of said material sheet in said generally aligned relation with the binding element results in actuation of said actuation assembly.

10. A binding assembly as recited in claim 1 wherein said displacement assembly is movably disposed between a pre-displacement orientation and a post-displacement orientation.

11. A binding assembly as recited in claim 10 wherein said displacement assembly is structured to automatically return to said pre-displacement orientation subsequent to passage into said post-displacement orientation.

12. A binding assembly as recited in claim 1 wherein said alignment assembly comprises an elongate housing including at least one of said retention trough defined therein and structured to maintain the binding element in a generally vertical orientation.

13. A binding assembly as recited in claim 12 wherein said elongate housing comprises a plurality of said retention troughs.

14. A binding assembly as recited in claim 12 wherein said retention trough is structured to maintain at least said perpendicular axis region of the binding element exposed for generally vertical engagement by the material sheet.

15. A binding assembly as recited in claim 12 wherein said guide assembly includes a stopper element structured to be engaged by the material sheet so as to resist movement of the material sheet beyond the perpendicular axis region of the binding element.

16. A binding assembly as recited in claim 15 further comprising a guide channel structured to retain a plurality of the binding elements for sequential positioning thereof into said retention trough.

17. A binding assembly as recited in claim 16 wherein said guide channel is variably sized to receive a correspondingly sized one of the binding elements.

18. A binding assembly as recited in claim 17 wherein said guide assembly includes a channel restrictor cooperatively disposed with said guide channel and structured to vary a size of said guide channel.

19. A binding assembly as recited in claim 18 wherein said guide assembly is structured to vary an engagement point of said stopper element in accordance with said size of said guide channel.

20. A binding assembly as recited in claim 19 further comprising an actuation assembly structured to initiate operation of said displacement assembly.

21. A binding assembly as recited in claim 20 wherein said actuation assembly is structured to mechanically drive said displacement assembly.

22. A binding assembly as recited in claim 21 wherein said actuation assembly includes an adjustable timing mechanism structured to vary a rate at which said actuation assembly drives said displacement assembly.

23. A binding assembly as recited in claim 1 wherein said displacement assembly comprises a plurality of said displacement elements disposed on opposite sides of a plurality of said retention troughs so as to engage the material sheet on said opposite sides of each of a plurality of the binding aperture and thereby urge said material sheet onto each of a corresponding plurality of the binding elements disposed in said retention troughs.

24. A binding assembly as recited in claim 1 further comprising an actuation assembly structured to move said displacement elements of said displacement assembly into engaging relation with the material sheet.

25. A binding assembly as recited in claim 24 wherein said actuation assembly comprises a lever arm structured to be manually actuated so as to move said displacement elements.

26. A binding assembly as recited in claim 24 wherein said actuation assembly comprises an automated actuation device structured to automatically move said displacement elements.

27. A binding assembly as recited in claim 26 wherein said actuation assembly comprises a switch structured to be triggered so as to begin operation of said automated actuation device.

28. A binding assembly as recited in claim 26 wherein said automated actuation device is structured to sequentially move said displacement assembly at a predefined rate.

29. To secure a plurality of material sheets having at least one binding aperture on a binding element of the type including a perimeter flange, a binding assembly comprising:

a housing, said housing including at least one retention trough defined therein and structured to maintain the binding element in a generally vertical orientation;

said retention trough being further structured to maintain at least a perpendicular axis region of the binding element exposed for generally vertical engagement by the material sheet;

a stopper element structured to be engaged by the material sheet so as to resist movement of at least one of the material sheets beyond the perpendicular axis region of the binding element and to position an edge of said at least one of the plurality of material sheets in generally aligned relation with said perpendicular axis region of the binding element; and a pair of displacement elements disposed on opposite sides of said retention trough and structured to engage the material sheet on opposite sides of the binding aperture, at least upon the material sheet engaging said stopper element, so as to urge the material sheet onto the binding element into coupled engagement with one another at the corresponding binding aperture of the material sheet.

30. A binding assembly as recited in claim 29 wherein said displacement element is movably disposed between a predisplacement orientation and a post-displacement orientation.

31. A binding assembly as recited in claim 30 wherein said displacement element is structured to automatically return to said pre-displacement orientation subsequent to passage into said post-displacement orientation.

32. A binding assembly as recited in claim 29 wherein said housing comprises a plurality of said retention troughs.

33. A binding assembly as recited in claim 29 further comprising a guide channel structured to retain a plurality of the binding elements for sequential positioning thereof into said retention trough.

34. A binding assembly as recited in claim 33 wherein said guide channel is variably sized to receive a correspondingly sized one of the binding elements.

35. A binding assembly as recited in claim 34 further comprising a channel restrictor cooperatively disposed with said guide channel and structured to vary a size of said guide channel.

36. A binding assembly as recited in claim 35 wherein an engagement point of said stopper element is variable in accordance with said size of said guide channel.

37. A binding assembly as recited in claim 36 wherein said stopper element and said channel restrictor are cooperatively disposed with one another so as to vary said engagement point of said stopper element in accordance with said size of the binding element.

38. A binding assembly as recited in claim 29 further comprising an actuation assembly structured to initiate operation of said displacement element.

39. A binding assembly as recited in claim 38 wherein said actuation assembly comprises a lever arm structured to be manually actuated so as to move said displacement element into engagement with the material sheet.

40. A binding assembly as recited in claim 38 wherein said actuation assembly comprises an automated actuation device structured to automatically move said displacement element.

41. A binding assembly as recited in claim 40 wherein said actuation assembly comprises a switch structured to be triggered so as to begin operation of said automated actuation device.

42. A binding assembly as recited in claim 29 comprising a plurality of said displacement elements disposed on opposite sides of a plurality of said retention troughs so as to engage the material sheet on opposite sides of each of a plurality of the binding apertures and thereby urge said material sheet onto each of a corresponding plurality of the binding elements disposed in said retention troughs.

43. A binding assembly as recited in claim 29 wherein said displacement element engages the material sheet and urges the material sheet into generally co-planer engagement with a confronting surface of the binding elements at generally said perpendicular axis region, so as to at least temporarily deform said binding apertures and permit passage of the perimeter flange of the binding elements therethrough.

44. To secure a plurality of material sheets having at least one binding aperture on a binding element of the type including a perimeter flange, a binding assembly comprising:

an alignment assembly structured to at least temporarily maintain the binding element generally perpendicular to a plane of the material sheet, said alignment assembly further comprising an elongate housing including at least one retention trough defined therein and structured to maintain the binding element in a generally vertical orientation;

a guide assembly structured to position an edge of at least one of the plurality of material sheets in generally aligned relation with a perpendicular axis region of the binding element;

a displacement assembly structured to urge the material sheet and the binding element into coupled engagement with one another at the corresponding binding aperture of the material sheet; and a guide channel structured to retain a plurality of the binding elements for sequential positioning thereof into said retention trough.

45. To secure a plurality of material sheets having at least one binding aperture on a binding element of the type including a perimeter flange, a binding assembly comprising:

a housing, said housing including at least one retention trough defined therein and structured to maintain the binding element in a generally vertical orientation;

said retention trough being further structured to maintain at least a perpendicular axis region of the binding element exposed for generally vertical engagement by the material sheet;

a stopper element structured to be engaged by the material sheet so as to resist movement of at least one of the material sheets beyond the perpendicular axis region of the binding element and to position an edge of said at least one of the plurality of material sheets in generally aligned relation with said perpendicular axis region of the binding element;

at least one displacement element structured to engage the material sheet at least upon said material sheet engaging said stopper element and to urge the material sheet and the binding element into coupled engagement with one another at the corresponding binding aperture of the material sheet; and a guide channel structured to retain a plurality of the binding elements for sequential positioning thereof into said retention trough.

46. To secure a plurality of material sheets having at least one binding aperture on a binding element of the type including a perimeter flange, a binding assembly comprising:

a housing, said housing including a plurality of retention trough defined therein and structured to maintain the binding element in a generally vertical orientation;

each said retention trough being further structured to maintain at least a perpendicular axis region of the binding element exposed for generally vertical engagement by the material sheet;

a stopper element structured to be engaged by the material sheet so as to resist movement of at least one of the material sheets beyond the perpendicular axis region of the binding element and to position an edge of said at least one of the plurality of material sheets in generally aligned relation with said perpendicular axis region of the binding element; and a plurality of said displacement elements disposed on opposite sides of said plurality of retention troughs structured to engage the material sheet on opposite sides of each of a plurality of binding apertures, at least upon said material sheet engaging said stopper element, so as to urge the material sheet onto each one of a corresponding plurality of binding elements disposed in said retention troughs into coupled engagement with one another at the corresponding binding apertures of the material sheet.

* * * * *